US011220808B2

(12) United States Patent
Tentler

(10) Patent No.: US 11,220,808 B2
(45) Date of Patent: Jan. 11, 2022

(54) KITCHEN FAUCET INCLUDING A ROTATABLE SUPPORT ARM

(71) Applicant: Delta Faucet Company, Indianapolis, IN (US)

(72) Inventor: Anthony Joseph Tentler, Windfall, IN (US)

(73) Assignee: Delta Faucet Company, Indianapolis, IN (US)

( * ) Notice: Subject to any disclaimer, the term of this patent is extended or adjusted under 35 U.S.C. 154(b) by 0 days.

(21) Appl. No.: 16/547,074

(22) Filed: Aug. 21, 2019

(65) Prior Publication Data

US 2020/0071917 A1 Mar. 5, 2020

Related U.S. Application Data

(60) Provisional application No. 62/724,302, filed on Aug. 29, 2018.

(51) Int. Cl.
*E03C 1/04* (2006.01)

(52) U.S. Cl.
CPC .... *E03C 1/0401* (2013.01); *E03C 2001/0414* (2013.01)

(58) Field of Classification Search
CPC ..... E03C 1/04; E03C 1/0401; E03C 1/0404; E03C 2001/0414; E03C 2001/0415
USPC ..... 137/801; 248/75, 212; 4/678, 695
See application file for complete search history.

(56) References Cited

U.S. PATENT DOCUMENTS

| | | | | |
|---|---|---|---|---|
| 1,714,232 | A | 5/1929 | Morris | |
| 2,492,049 | A | 10/1947 | Krone et al. | |
| 3,726,318 | A | 4/1973 | Hyde | |
| 5,185,893 | A | 2/1993 | Lin | |
| 7,097,122 | B1 * | 8/2006 | Farley | E03C 1/0409 239/553 |
| D527,796 | S | 9/2006 | Lammel | |
| D585,110 | S | 1/2009 | Paini | |
| D620,557 | S | 7/2010 | Eilmus | |
| 8,061,386 | B2 | 11/2011 | Mueller et al. | |
| 8,070,076 | B2 | 12/2011 | Erickson et al. | |
| D685,881 | S | 7/2013 | Fritz | |
| 8,621,681 | B2 | 1/2014 | Macan et al. | |
| 8,869,821 | B2 | 10/2014 | Laera | |
| 9,435,107 | B2 | 9/2016 | Rexach et al. | |
| 9,568,132 | B2 | 2/2017 | Erickson et al. | |
| D783,780 | S | 4/2017 | Clarke | |
| 9,850,642 | B2 | 12/2017 | Enlow et al. | |

(Continued)

FOREIGN PATENT DOCUMENTS

| | | |
|---|---|---|
| CN | 107461528 | 12/2017 |

OTHER PUBLICATIONS

Brizo, Single Handle Articulating Kitchen Faucet, retrieved from https://www.brizo.com/kitchen/product/63221LF-PC on May 10, 2018.

(Continued)

*Primary Examiner* — Paul J Gray

(74) *Attorney, Agent, or Firm* — Bose McKinney & Evans LLP

(57) ABSTRACT

A faucet including a base, an arm including a first end supported by the base, and a sprayer assembly supported by a second end of the arm. The first end of the arm is pivotable about a first pivot axis, and the sprayer assembly is pivotable about a second pivot axis.

24 Claims, 7 Drawing Sheets

(56) References Cited

U.S. PATENT DOCUMENTS

| | | | | |
|---|---|---|---|---|
| 2006/0180222 | A1 | 8/2006 | Kang | |
| 2007/0251590 | A1 | 11/2007 | Weinstein | |
| 2015/0308088 | A1* | 10/2015 | Enlow | E03C 1/0404 137/1 |
| 2017/0350104 | A1 | 12/2017 | Clarke et al. | |
| 2017/0362803 | A1 | 12/2017 | Enlow et al. | |

OTHER PUBLICATIONS

Kohler, Articulating two-hole deck-mount kitchen sink faucet with 13" spout with Bronze tube, retrieved from https://www.us.kohler.com/uS/Karbon-articulating-two-hole-deck-mount-kitchen-sink-faucet-with-13-spout-with-Bronze-tube/productDetail/Kitchen-Sink-Faucets/427290.htm?categoryId=432333&skuId=405115&hash=id%3Dfilters%26136%D4294967128.com.

* cited by examiner

KITCHEN FAUCET INCLUDING A ROTATABLE SUPPORT ARM

CROSS-REFERENCE TO RELATED APPLICATION

The present application claims priority to U.S. Provisional Patent Application Ser. No. 62/724,302, filed on Aug. 29, 2018, the disclosure of which is expressly incorporated by reference herein.

BACKGROUND AND SUMMARY OF THE DISCLOSURE

The present invention relates generally to faucets. More particularly, the present invention relates to a kitchen faucet including a rotatable support arm with a removably supported sprayhead.

Positionable faucets (e.g., articulating) are a popular kitchen faucet option, allowing users to reposition a sprayhead and direct water flow around the sink. However, known faucets may not provide the user with sufficient mobility to position the sprayhead wherever they choose. Furthermore, such faucets may require considerable force to reposition, or cannot support themselves in each position the user chooses.

It is desired to provide a positionable kitchen faucet with an easy to move sprayhead, while still retaining the ability to maintain the sprayhead at any desired position.

In one illustrative embodiment of the present disclosure, a faucet includes a base having an interior and defining a longitudinal axis, an arm extending between a first end and a second end wherein the first end is supported by the base, a flexible waterway fluidly coupling a fluid source to a fluid outlet, a sprayer assembly defining the fluid outlet and supported by the second end of the arm, and a sprayer nest supporting the sprayer assembly. A first pivot coupling defines a first pivot axis and extends perpendicular to the longitudinal axis. The first end of the arm is pivotable about the first pivot axis to selectively position the second end of the arm relative to the base. A second pivot coupling defines a second pivot axis, laterally offset from the first pivot coupling and extending parallel to the first pivot axis. The sprayer nest is pivotable about the second pivot axis to selectively position the sprayer assembly relative to the second end of the arm. The first pivot axis, the second pivot axis, and the arm between the first and second pivot couplings extend within an orientation plane.

In another illustrative embodiment of the present disclosure, a faucet includes a base having an interior and defining a z-axis extending vertically from the base, an arm supported by the base, a flexible waterway fluidly coupling a fluid source to a fluid outlet, and a sprayer nest supported by the arm. A line extending perpendicular to the z-axis defines an x-axis. A sprayer assembly defines the fluid outlet and is supported by the sprayer nest. A first pivot coupling defines a first pivot axis extending parallel to the x-axis. The arm is pivotable about the first pivot axis to selectively position the arm relative to the base. A second pivot coupling defines a second pivot axis extending parallel to the x-axis and laterally offset from the first pivot coupling. The sprayer nest is pivotable about the second pivot axis to selectively position the sprayer nest relative to the arm.

In another illustrative embodiment of the present disclosure, a faucet includes a base having an interior and defining a z-axis, a hub supported by the base for rotation around the z-axis, and an arm extending between a first end and a second end. A line extending perpendicular to the z-axis defines an x-axis. The first end of the arm is pivotally coupled to the hub at a first pivot coupling. The first pivot coupling defines a first pivot axis parallel to the x-axis, wherein the arm is pivotable about the first pivot axis to selectively position the second end of the arm relative to the base. A sprayer nest is pivotally coupled to the second end of the arm at a second pivot coupling. The second pivot coupling defines a second pivot axis parallel to the x-axis, the sprayer nest pivotable about the second pivot axis to selectively position the sprayer nest relative to the first end of the arm.

Additional features and advantages of the present invention will become apparent to those skilled in the art upon consideration of the following detailed descriptions of the illustrative embodiment best exemplifying the best mode of carrying out the invention as presently perceived.

BRIEF DESCRIPTION OF THE DRAWINGS

A detailed description of the drawings particularly refers to the accompanying figures in which.

DETAILED DESCRIPTION OF THE DRAWINGS

The embodiments of the invention described herein are not intended to be exhaustive or to limit the invention to the precise forms disclosed. Rather, the embodiments selected for description have been chosen to enable one skilled in the art to practice the invention.

Figure 1:
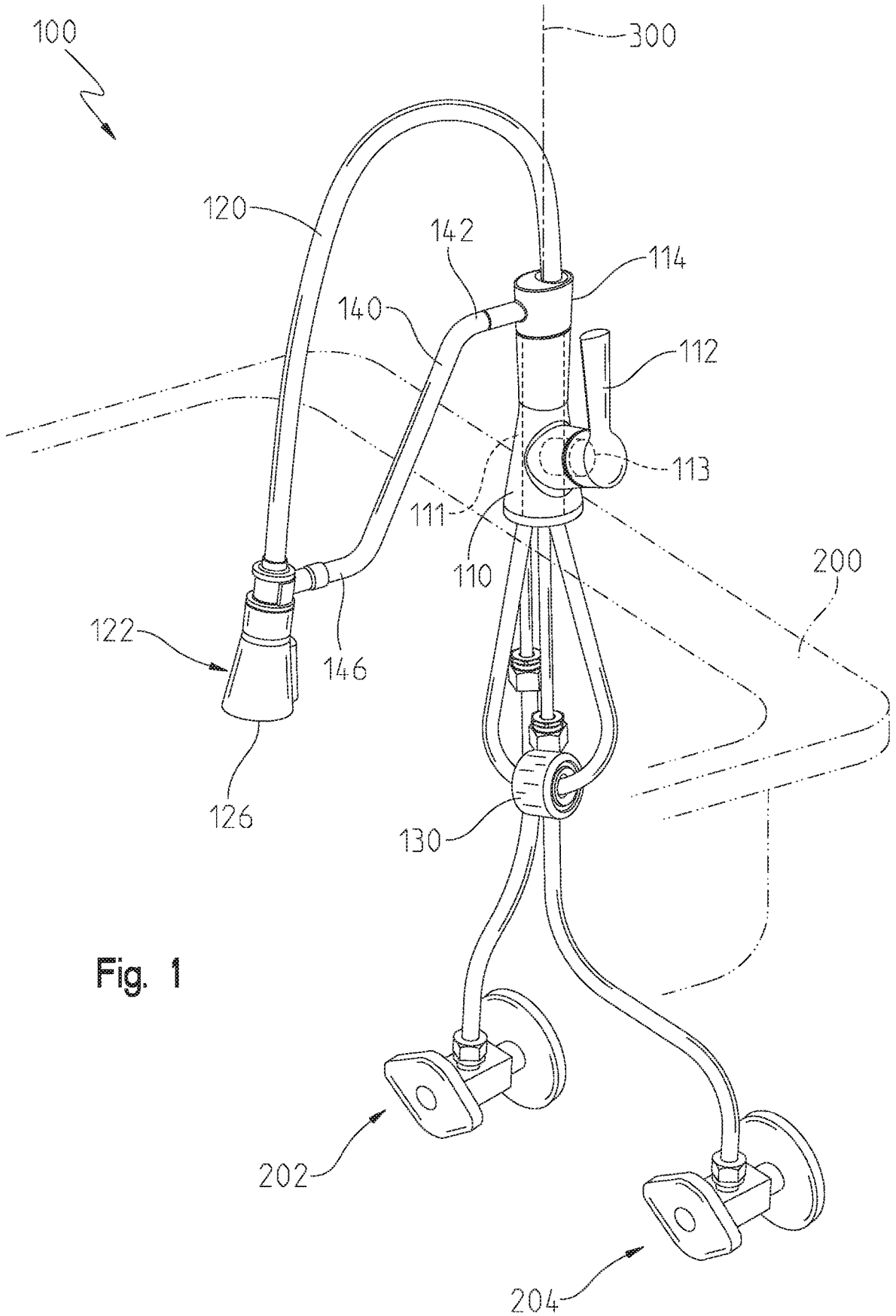
FIG. 1 is a perspective view of an exemplary faucet of the present disclosure mounted on a sink basin with the sprayhead coupled to a docking nest supported by an arm and positioned vertically downward.

Referring initially to FIG. 1, an exemplary faucet 100 is shown mounted to a sink basin 200, and fluidly connected to a fluid source (illustratively, a hot water source 202 and a cold water source 204) which directs fluid through a conventional mixing valve 113 in order to adjust the temperature and the flow rate of the fluid. In the illustrated embodiment, the faucet 100 comprises a base 110 which is mounted to the sink basin 200 and includes an interior 111, a handle 112, and a hub 114. Hub 114 is pivotally coupled to base 110 such that hub 114 can rotate about longitudinal axis 300. In the illustrated embodiment, handle 112 is a lever coupled to mixing valve 113 and can be positioned at varying angles away from the base 110 to regulate fluid flow through the faucet 100. Furthermore, handle 112 can be rotated towards or away from the user to adjust the temperature of the fluid. In other embodiments, other handle configurations may be used to control the flow rate and temperature of fluid through the faucet 100.

Figure 2:
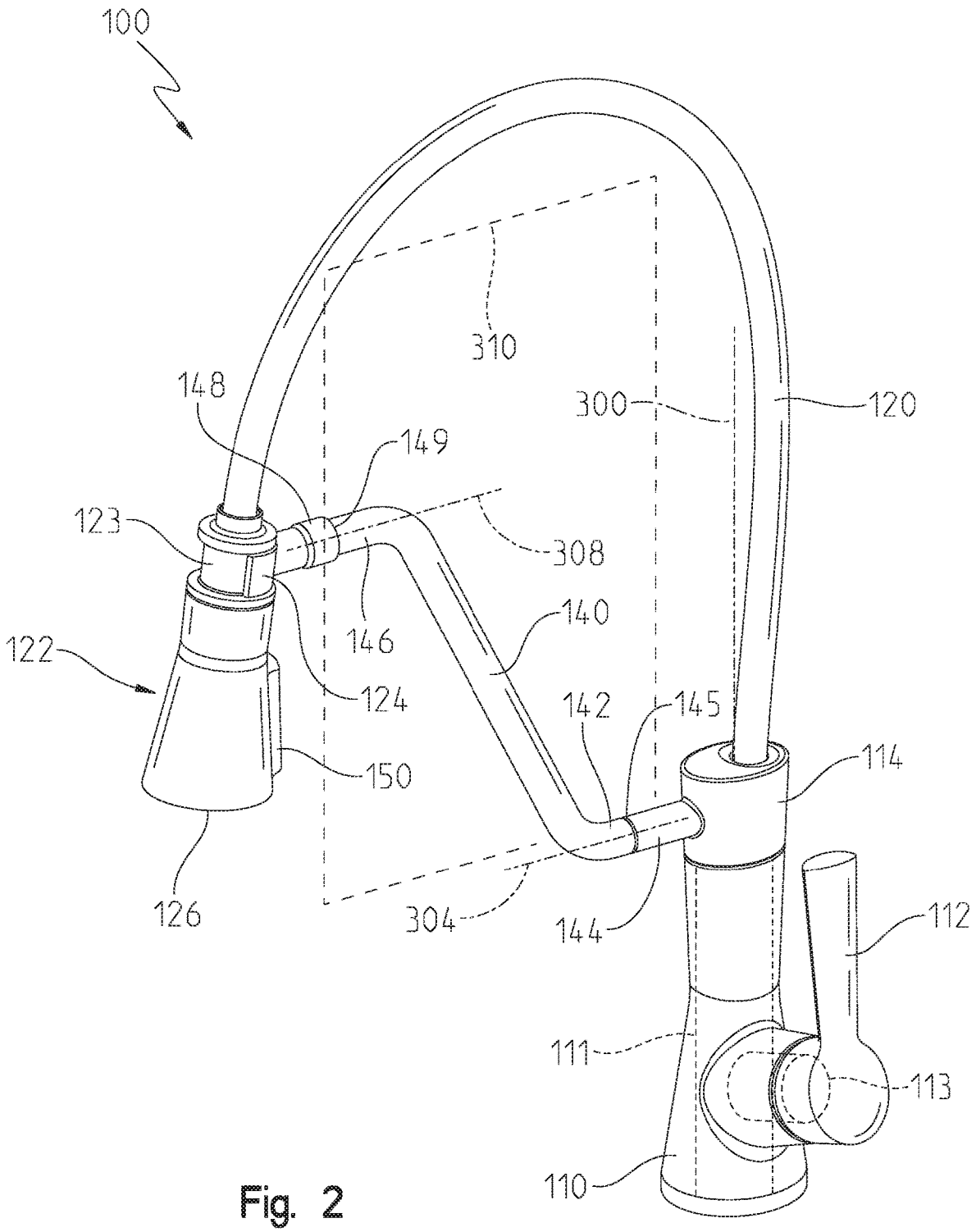
FIG. 2 is a front view of the faucet of FIG. 1, with the sprayhead shown in an intermediate position.
Figure 3:
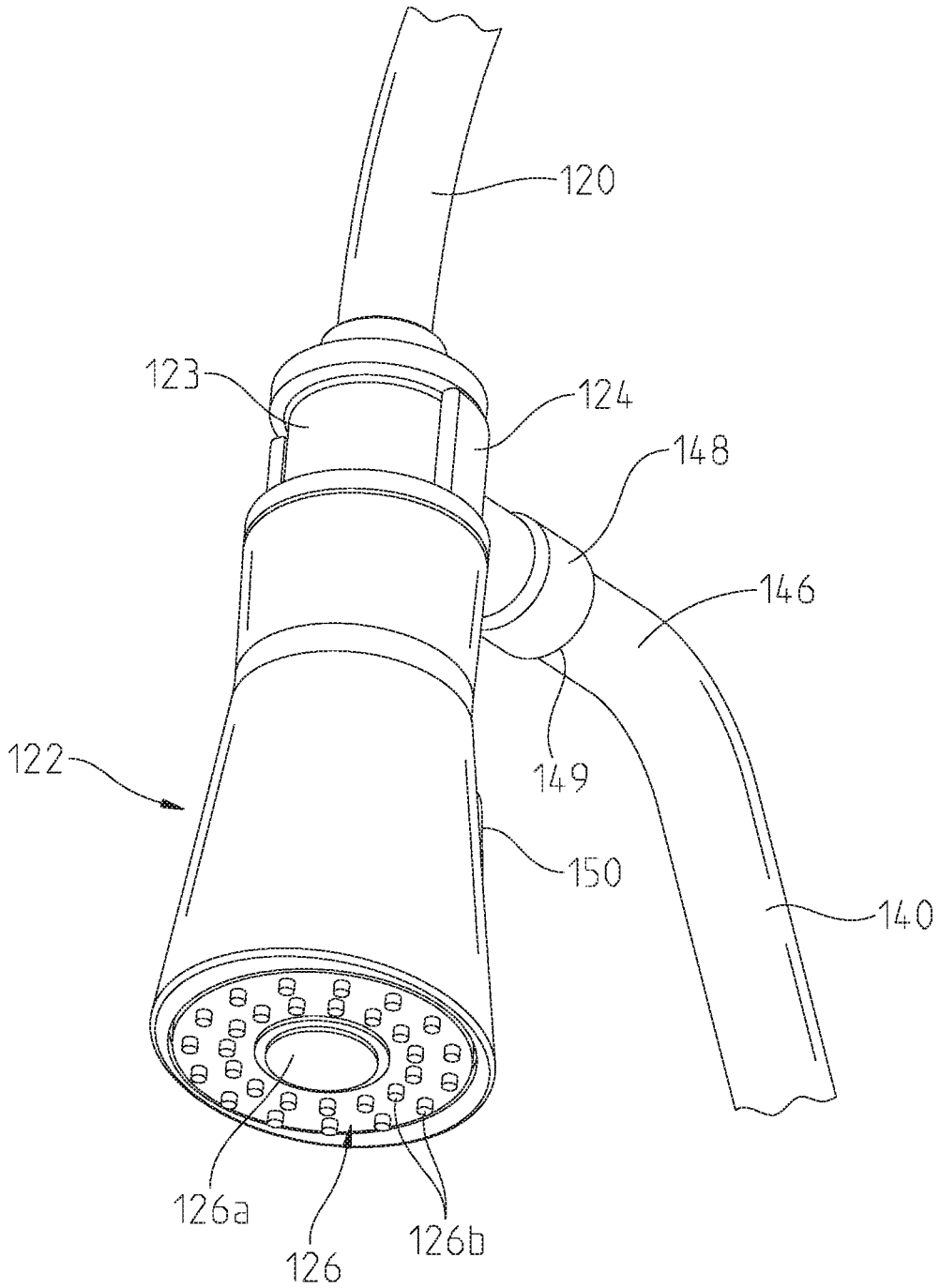
FIG. 3 is a detailed perspective view of the sprayhead of FIG. 1, as shown coupled to the docking nest supported by the arm of the faucet.
Figure 4:
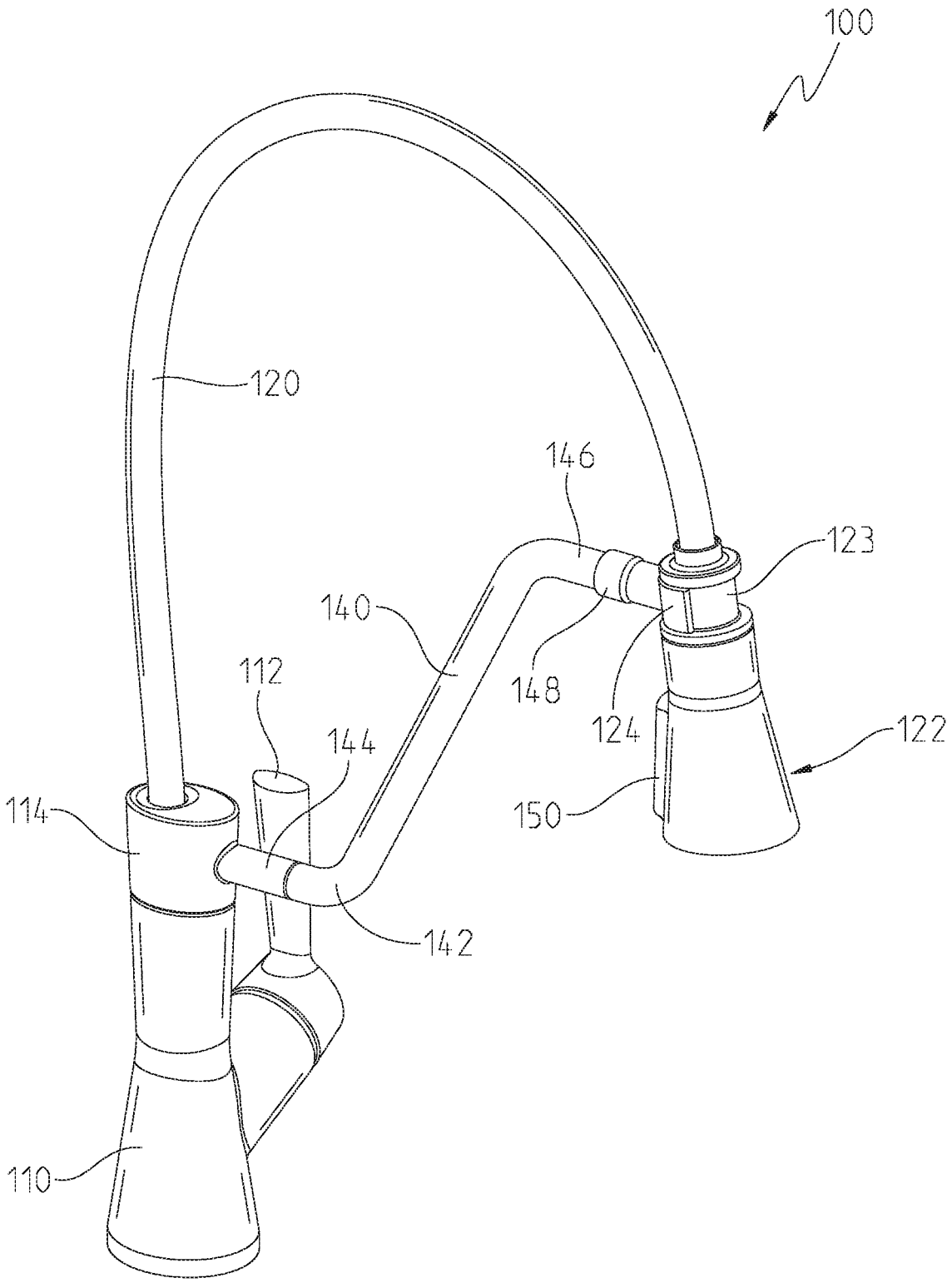
FIG. 4 is a perspective view of the faucet of FIG. 1, with the sprayhead shown in a raised position.

Referring to FIGS. 1, 2, and 4, faucet 100 further comprises a flexible waterway 120 which fluidly couples mixing valve 113 to a sprayer assembly or sprayhead 122 defining a fluid outlet 126 (FIG. 3). In the illustrated embodiment, flexible waterway 120 passes at least partially through, and is slidably received within, the interior 111 of the base 110 and extends vertically upward from the base 110 parallel to longitudinal axis 300 (FIG. 2). Flexible waterway 120 may bend, stretch, compress, or otherwise flex so that the user may move the fluid outlet 126 relative to the base 110. Flexible waterway 120 may be composed of rubber, plastic, or any other flexible material suitable for fluid flow and may also be coated in a waterproof coating. A hose weight 130 may be coupled to the waterway 120 below the sink basin 200.

With reference to FIG. 2, faucet 100 further comprises an arm 140 extending between a first end 142 and a second end 146, and is positioned below an upper portion of the waterway 120. First end 142 of arm 140 is supported by the base 110 and is pivotally coupled to the hub 114 at a first pivot coupling 144, defining a first pivot axis 304. First end 142 of arm 140 can rotate about first pivot axis 304 to position second end 146 of arm 140 relative to the base 110. In the illustrated embodiment, first pivot coupling 144 includes a first friction bearing 145. The first friction bearing 145 may include a plurality of troughs and ridges (not shown) contacting the first end 142 of arm 140 and the hub 114 to pivotally maintain the position of the second end 146 of arm 140 relative to the base 110.

Figure 7:
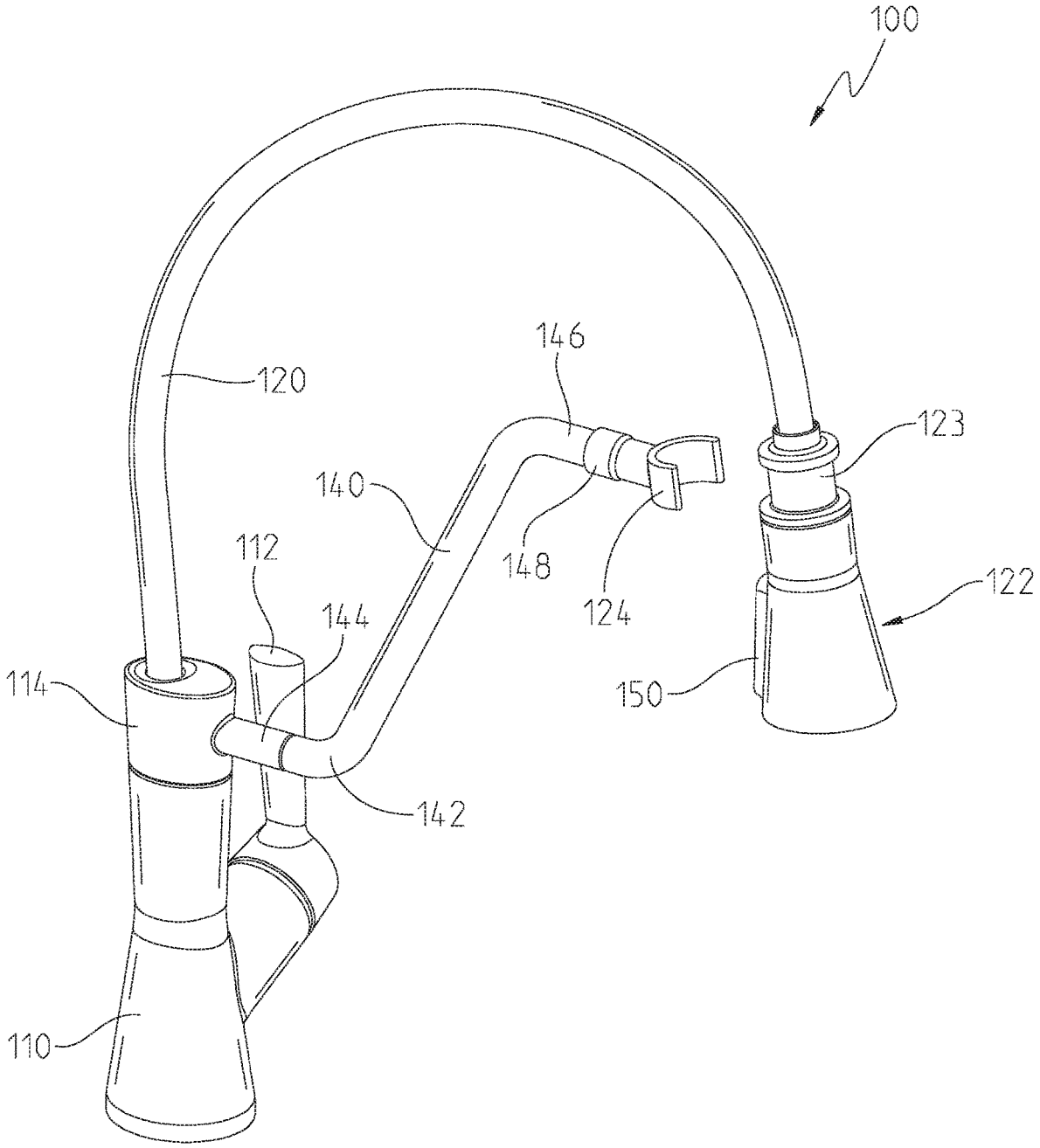
FIG. 7 is a perspective view of the faucet of FIG. 4, with the sprayhead shown removed from the docking nest.

Referring further to FIGS. 2 and 3, second end 146 of arm 140 illustratively supports sprayer assembly or sprayhead 122 which includes a neck 123. In the illustrated embodiment, flexible waterway 120 is fluidly coupled to sprayer assembly 122 which defines fluid outlet 126. In the illustrated embodiment, sprayer assembly 122 is releasably coupled to a sprayer nest or cradle 124. Sprayer nest 124 is sized to receive neck 123 of sprayer assembly 122, and sprayer assembly 122 is removably coupled to sprayer nest 124. In other illustrative embodiments, at least the sprayer assembly 122 or the sprayer nest 124 includes a magnet and at least the other of the sprayer assembly 122 or the sprayer nest 124 contains a magnetically attractive material so that the sprayer assembly 122 may be removably coupled to sprayer nest 124 with a magnet. When uncoupled from sprayer nest 124, sprayer assembly 122 may be moved relative to base 110 by the user while remaining attached (fluidly coupled) to flexible waterway 120 (FIG. 7). The sprayer assembly 122 may also include a user interface, such as a rocker switch 150, to toggle water flow between a center stream (e.g., an aerated stream) 126*a* or sprayer outlets 126*b*.

Sprayer nest 124 is pivotally coupled to second end 146 of arm 140 at a second pivot coupling 148, defining a second pivot axis 308. Second pivot coupling 148 and second pivot axis 308 are laterally offset from first pivot coupling 144 and first pivot axis 304. Sprayer nest 124 can rotate about second pivot axis 308 to position sprayer nest 124 relative to second end 146 of arm 140. In the illustrated embodiment, second pivot coupling 148 includes a second friction bearing 149, the second friction bearing 149 may include a plurality of troughs and ridges (not shown) contacting the sprayer nest 124 and the second end 146 of arm 140 to pivotally maintain the position of sprayer nest 124 relative to second end 146 of arm 140.

In the illustrated embodiment, first pivot coupling 144, the center of sprayer nest 124, and a point on arm 140 between first pivot coupling 144 and second pivot coupling 148 define an orientation plane 310. First pivot axis 304 and second pivot axis 308 lie within the orientation plane 310. The orientation plane 310 will shift with each arrangement of the faucet 100, and first pivot axis 304 and second pivot axis 308 will lie within the orientation plane 310 at each positioning of the faucet 100.

In the illustrated embodiment, an x-axis can be defined by a line extending perpendicular to longitudinal axis 300. Second pivot axis 308 and first pivot axis 304 both lie parallel to the x-axis.

Figure 5:
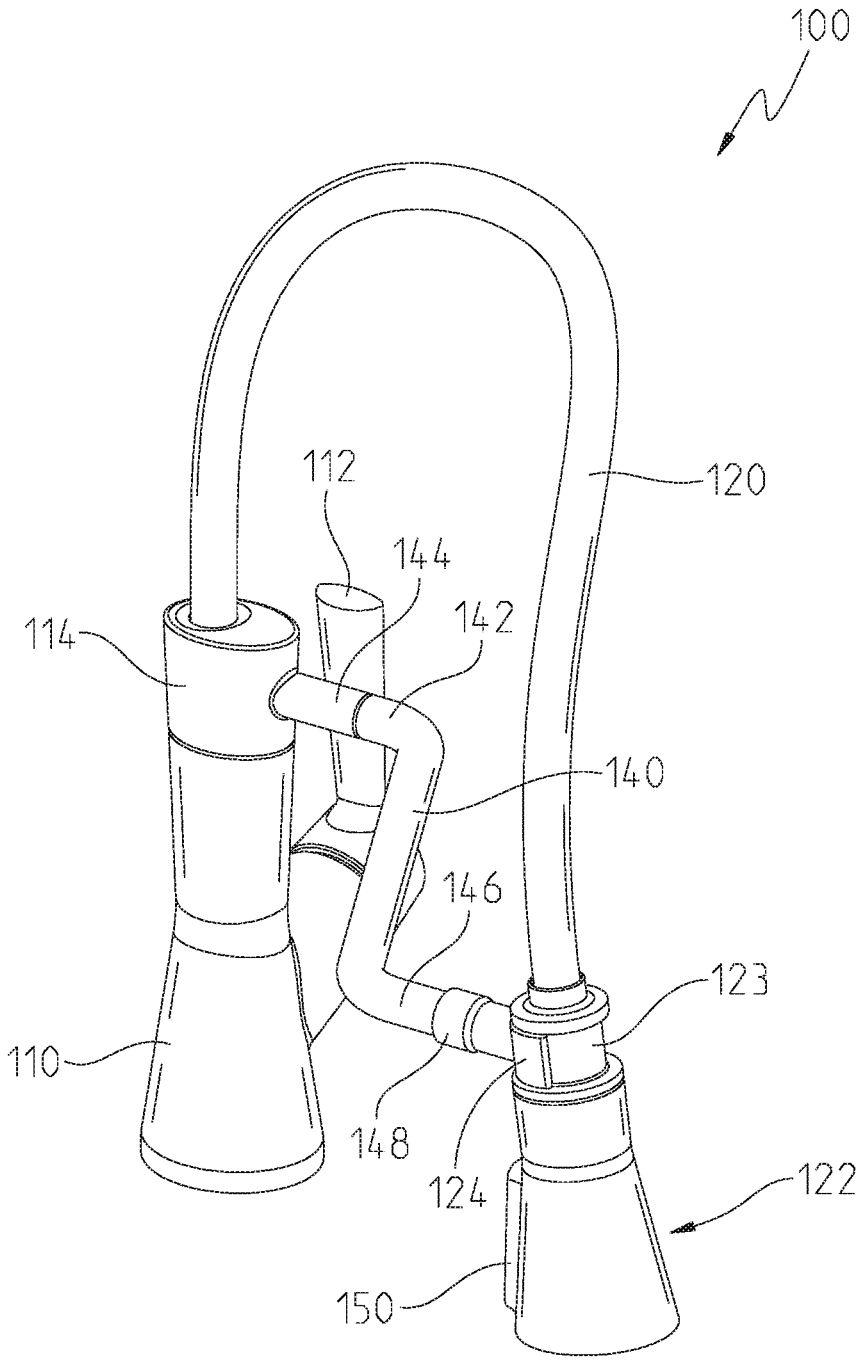
FIG. 5 is a perspective view of the faucet of FIG. 4, with the sprayhead shown in an intermediate position.
Figure 6:
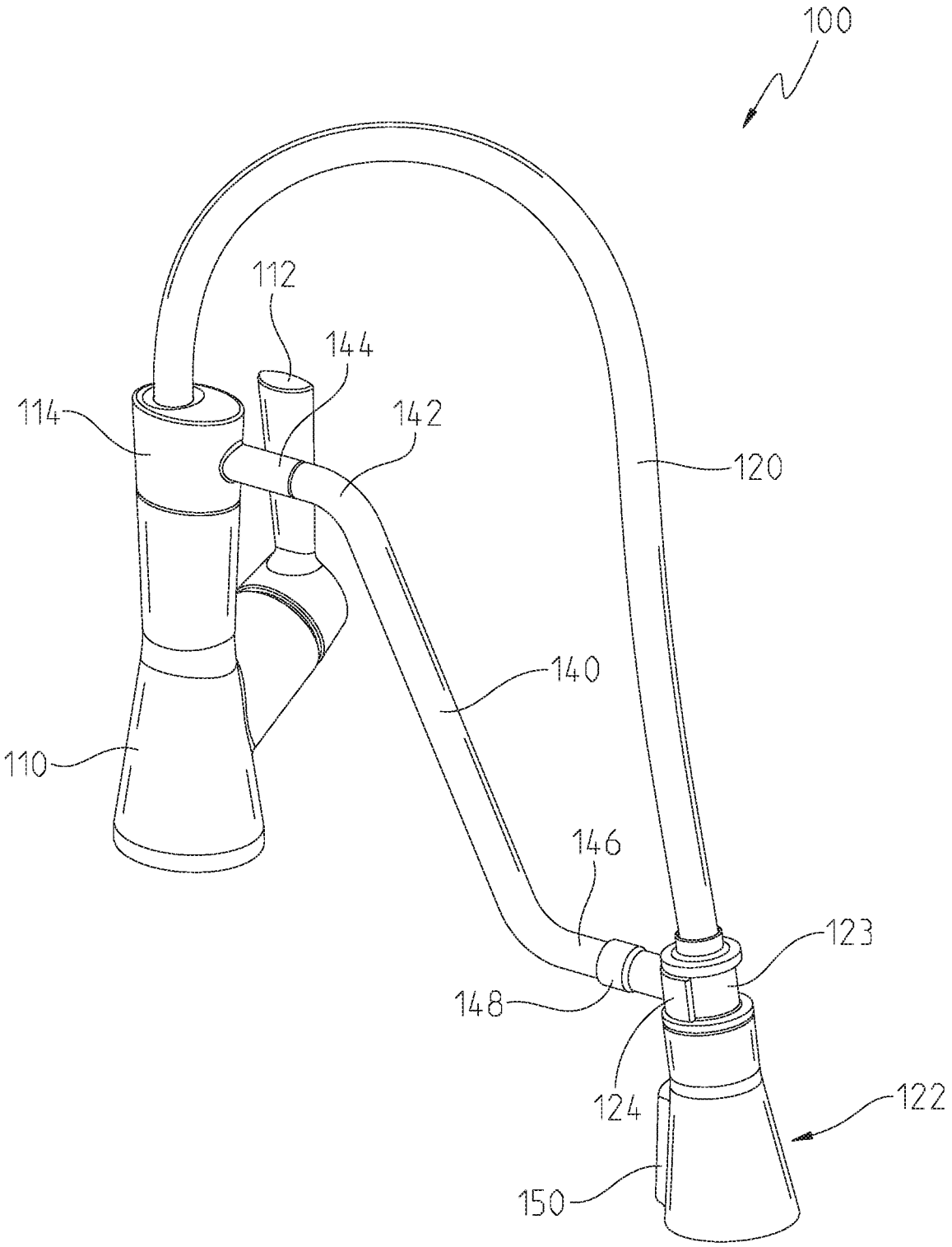
FIG. 6 is a perspective view of the faucet of FIG. 4, with the sprayhead shown in a lowered position.

With reference to FIGS. 4-6, first and second pivot couplings 144 and 148 allow a user to position sprayer assembly 122 in a plurality of locations relative to base 110. In a first or raised position (FIG. 4), first end 142 of arm 140 is rotated about first pivot axis 304 to position second end 146 of arm 140 vertically above base 110. Sprayer nest 124 is rotated about second pivot axis 308 to direct the sprayer assembly 122 vertically downward, such that fluid outlet 126 directs fluid flow vertically downward from sprayer assembly 122. From this position, faucet 100 may be repositioned to a second or intermediate position (FIG. 5) by rotating first end 142 of arm 140 clockwise from the perspective of a user in front of the faucet until second end 146 of arm 140 is positioned at an angle from longitudinal axis 300. The faucet 100 may be further repositioned to a third or lowered position by rotating first end 142 of arm 140 clockwise from the perspective of a user in front of the faucet 100 until second end 146 of arm is positioned vertically below base 110. The faucet 100 may be positioned in a plurality of positions by rotating arm 140 about first pivot axis 304 as described either clockwise or counterclockwise, and by rotating sprayer nest 124 about second pivot axis 308 either clockwise or counterclockwise to direct the sprayer assembly 122 to a plurality of positions (FIG. 6).

Although the invention has been described in detail with reference to certain preferred embodiments, variations and modifications exist within the spirit and scope of the invention as described and defined in the following claims.

The invention claimed is:

1. A faucet comprising:

a base including an interior and defining a longitudinal axis;

an arm extending between a first end and a second end, the first end supported by the base;

a flexible waterway fluidly coupling a fluid source to a fluid outlet; a sprayer assembly defining the fluid outlet and supported by the second end of the arm; a sprayer nest supporting the sprayer assembly;

a first pivot coupling defining a first pivot axis extending perpendicular to the longitudinal axis, the first end of the arm pivotable about the first pivot axis to selectively position the second end of the arm relative to the base;

a second pivot coupling defining a second pivot axis extending parallel to the first pivot axis, and laterally offset from the first pivot coupling, the sprayer nest pivotable about the second pivot axis to selectively position the sprayer assembly relative to the second end of the arm; and the first pivot axis, the second pivot axis, and the arm between the first and second pivot couplings extend within an orientation plane, wherein, between the first pivot coupling and the second pivot coupling, the arm includes a first bend defining a first non-perpendicular angle and a second bend defining a second non-perpendicular angle whereby the second pivot coupling is displaced from the first pivot coupling in the orientation plane both in a direction parallel with the first pivot axis and in a direction perpendicular to the first pivot axis.

2. The faucet of claim 1, wherein the waterway at least partially passes through the interior of the base.

3. The faucet of claim 1, wherein the sprayer assembly is releasably coupled to the sprayer nest.

4. The faucet of claim 1, wherein the first pivot coupling includes a first friction bearing positioned between the arm and the base, the first friction bearing including a plurality of ridges and troughs contacting the arm and the base, wherein the first friction bearing maintains a position of the arm relative to the base.

5. The faucet of claim 1, wherein the second pivot coupling includes a second friction bearing positioned between the sprayer nest and the arm, the second friction bearing including a plurality of ridges and troughs contacting the nest and the arm, wherein the second friction bearing maintains a position of the nest relative to the arm.

6. The faucet of claim 1, further comprising a hub supported by the base for rotation about the longitudinal axis wherein the arm extends between the first end and the second end, the first end of the arm pivotally coupled to the hub at the first pivot coupling.

7. The faucet of claim 6, wherein the waterway extends from the hub to the sprayer assembly above the arm.

8. The faucet of claim 7, wherein at least one of the sprayer assembly and the sprayer nest includes a magnet and the other of the sprayer assembly and the sprayer nest includes a magnetically attractive element, wherein the magnet removably couples the sprayer assembly to the sprayer nest.

9. The faucet of claim 1, further comprising a mixing valve supported by the base and fluidly coupled to the waterway, and a handle connected to the mixing valve and extending outwardly from the base.

10. A faucet comprising:

a base including an interior and defining a z-axis extending vertically from the base;

an arm supported by the base;

a flexible waterway fluidly coupling a fluid source to a fluid outlet;

a sprayer nest supported by the arm;

a sprayer assembly defining the fluid outlet and supported by the sprayer nest;

a first pivot coupling defining a first pivot axis extending parallel to an x-axis wherein the x-axis intersects and is perpendicular to the z-axis, the arm pivotable about the first pivot axis to selectively position the arm relative to the base;

a second pivot coupling defining a second pivot axis intersecting the sprayer nest and extending parallel to the x-axis and offset from the first pivot coupling, the sprayer nest pivotable about the second pivot axis to selectively position the sprayer nest relative to the arm; and wherein the arm projects from the first pivot coupling to the second pivot coupling such that the second pivot coupling is displaced from the first pivot coupling in both a direction parallel with the first pivot axis and a direction perpendicular with the first pivot axis; and wherein the second pivot coupling is the only pivot coupling disposed between the arm and the fluid outlet when the sprayer assembly is supported by the sprayer nest.

11. The faucet of claim 10, wherein the sprayer assembly comprises a neck sized to be received by the sprayer nest.

12. The faucet of claim 10, wherein the waterway at least partially passes through the interior of the base.

13. The faucet of claim 10, wherein the first pivot coupling includes a first friction bearing positioned between the arm and the base, wherein the first friction bearing maintains a position of the arm relative to the base.

14. The faucet of claim 10, wherein the second pivot coupling includes a second friction bearing positioned between the sprayer nest and the arm, wherein the second friction bearing maintains a position of the nest relative to the arm.

15. The faucet of claim 10, further comprising a hub supported by the base for rotation about the z-axis wherein the arm extends between a first end and a second end, the first end of the arm pivotally coupled to the hub at the first pivot coupling.

16. The faucet of claim 15, wherein the waterway extends from the hub to the sprayer assembly above the arm.

17. The faucet of claim 10, wherein the sprayer assembly is removably coupled to the sprayer nest.

18. The faucet of claim 17, wherein at least one of the sprayer assembly and the sprayer nest includes a magnet and the other of the sprayer assembly and the sprayer nest includes a magnetically attractive element, wherein the magnet removably couples the sprayer assembly to the sprayer nest.

19. A faucet comprising:

a base including an interior and defining a z-axis;

a hub supported by the base for rotation around the z-axis;

an arm extending between a first end and a second end, the first end pivotally coupled to the hub at a first pivot coupling, the first pivot coupling defining a first pivot axis parallel to an x-axis wherein the x-axis intersects and is perpendicular to the z-axis, the arm pivotable about the first pivot axis to selectively position the second end of the arm relative to the base;

a sprayer nest pivotally coupled to the second end of the arm at a second pivot coupling, the second pivot coupling defining a second pivot axis which intersects the sprayer nest and extends parallel to the x-axis, the sprayer nest being pivotable about the second pivot axis to selectively position the sprayer nest relative to the first end of the arm;

wherein the first pivot axis, the second pivot axis, and the arm between the first and second pivot couplings extend within an orientation plane, wherein the arm projects from the first pivot coupling to the second pivot coupling such that the second pivot coupling is displaced from the first pivot coupling in the orientation plane both in a direction parallel with the first pivot axis and in a direction perpendicular with the first pivot axis; and wherein the second pivot coupling is the only pivot coupling disposed between the arm and a fluid outlet defined by a sprayer assembly when the sprayer assembly is supported by the sprayer nest.

20. The faucet of claim 19, wherein at least one of the sprayer assembly and the sprayer nest includes a magnet and the other of the sprayer assembly and the sprayer nest includes a magnetically attractive element, wherein the magnet removably couples the sprayer assembly to the sprayer nest.

21. The faucet of claim 19, wherein a flexible waterway extends from the hub to the sprayer assembly.

22. A faucet comprising:

a base including an interior and defining a z-axis extending vertically from the base;

an arm supported by the base;

a flexible waterway fluidly coupling a fluid source to a fluid outlet;

a sprayer nest supported by the arm;

a sprayer assembly defining the fluid outlet and supported by the sprayer nest;

a first pivot coupling defining a first pivot axis extending parallel to an x-axis wherein the x-axis intersects and is perpendicular to the z-axis, the arm pivotable about the first pivot axis to selectively position the arm relative to the base;

a second pivot coupling defining a second pivot axis intersecting the sprayer nest and extending parallel to the x-axis and offset from the first pivot coupling, the sprayer nest pivotable about the second pivot axis to selectively position the sprayer nest relative to the arm;

wherein the arm projects from the first pivot coupling to the second pivot coupling such that the second pivot coupling is displaced from the first pivot coupling in both a direction parallel with the first pivot axis and a direction perpendicular with the first pivot axis; and wherein the first pivot coupling and the second pivot coupling are the only pivot couplings disposed between the base and the sprayer nest.

23. The faucet of claim 19, A faucet comprising:

a base including an interior and defining a z-axis;

a hub supported by the base for rotation around the z-axis;

an arm extending between a first end and a second end, the first end pivotally coupled to the hub at a first pivot coupling, the first pivot coupling defining a first pivot axis parallel to an x-axis wherein the x-axis intersects and is perpendicular to the z-axis, the arm pivotable about the first pivot axis to selectively position the second end of the arm relative to the base;

a sprayer nest pivotally coupled to the second end of the arm at a second pivot coupling, the second pivot coupling defining a second pivot axis which intersects the sprayer nest and extends parallel to the x-axis, the sprayer nest being pivotable about the second pivot axis to selectively position the sprayer nest relative to the first end of the arm;

wherein the first pivot axis, the second pivot axis, and the arm between the first and second pivot couplings extend within an orientation plane, wherein the arm projects from the first pivot coupling to the second pivot coupling such that the second pivot coupling is displaced from the first pivot coupling in the orientation plane both in a direction parallel with the first pivot axis and in a direction perpendicular with the first pivot axis; and wherein the first pivot coupling and the second pivot coupling are the only pivot couplings disposed between the hub and the sprayer nest.

24. A faucet comprising:

a base including an interior and defining a longitudinal axis;

a hub supported by the base for rotation around the longitudinal axis;

an arm extending between a first end and a second end, the first end supported by the hub;

a flexible waterway fluidly coupling a fluid source to a fluid outlet; a sprayer assembly defining the fluid outlet and supported by the second end of the arm; a sprayer nest supporting the sprayer assembly;

a first pivot coupling defining a first pivot axis extending perpendicular to the longitudinal axis, the first end of the arm pivotable about the first pivot axis to selectively position the second end of the arm relative to the base;

a second pivot coupling defining a second pivot axis extending parallel to the first pivot axis, and laterally offset from the first pivot coupling, the sprayer nest pivotable about the second pivot axis to selectively position the sprayer assembly relative to the second end of the arm; and the first pivot axis, the second pivot axis, and the arm between the first and second pivot couplings extend within an orientation plane, wherein the second pivot coupling is displaced from the first pivot coupling in the orientation plane both in a direction parallel with the first pivot axis and in a direction perpendicular to the first pivot axis, and wherein the first pivot coupling and the second pivot coupling are the only pivot couplings disposed between the hub and the sprayer nest.

* * * * *